US005979024A

United States Patent [19]

Renwick

[11] Patent Number: 5,979,024

[45] Date of Patent: Nov. 9, 1999

[54] HOLDER FOR FIBROUS PRODUCT

[76] Inventor: Richard Renwick, Wynewell, Leazes Lane, Hexham, Northumberland, United Kingdom, NE46 3AZ

[21] Appl. No.: 09/023,423

[22] Filed: Feb. 13, 1998

[30] Foreign Application Priority Data

Feb. 14, 1997 [GB] United Kingdom ..... 9703130

[51] Int. Cl.[6] ..... A44B 13/00

[52] U.S. Cl. ..... 24/442; 24/446; 24/450

[58] Field of Search ..... 24/442, 443, 444, 24/445, 446, 447, 450, 452, 306, 449

[56] References Cited

U.S. PATENT DOCUMENTS

| | | | |
|---|---|---|---|
| 2,662,559 | 12/1953 | Miller | 24/442 |
| 3,494,006 | 2/1970 | Brumlik | 24/447 |
| 3,522,637 | 8/1970 | Brumlik | 24/445 |
| 3,708,833 | 1/1973 | Ribich et al. | 24/450 |
| 4,180,890 | 1/1980 | Brumlik | 24/449 |
| 4,707,893 | 11/1987 | Hashizume et al. | 24/446 |
| 5,369,853 | 12/1994 | Okawa et al. | 24/446 |
| 5,551,173 | 9/1996 | Chambers | 36/44 |
| 5,685,050 | 11/1997 | Murasaki | 24/442 |

FOREIGN PATENT DOCUMENTS

A-1214721 12/1970 United Kingdom .

*Primary Examiner*—Victor N. Sakran
*Attorney, Agent, or Firm*—Larson & Taylor

[57] ABSTRACT

A holder, primarily for retaining thereon a non-woven fibrous pad which is to be attached to, to be rotated by, a cleaning machine, comprises a base member of a resilient elastomeric material and a plurality of hook members integrally moulded with the base member to project from a surface thereof, each hook member including a stem portion on the free end of which, remote from the base member, is formed at least one barb portion extending laterally from the stem portion, some of the stem portions being longer than others of the stem portions, the hook members serving positively to retain the pad on the holder but enabling the pad to be readily removed from the holder as required.

5 Claims, 2 Drawing Sheets

HOLDER FOR FIBROUS PRODUCT

BACKGROUND OF THE INVENTION

This invention relates to a holder for fibrous products, and more particularly to a holder for non-woven fibrous pads primarily for abrasive cleaning purposes.

It is well established practice to provide cleaning machines to scrub, polish, clean, burnish or otherwise treat surfaces, in particular floors, such machines commonly incorporating rotatable fibrous, non-woven pads or discs of varying abrasive qualities dependent upon the task involved.

For reasons of simplicity and convenience, it is desirable that the pads can be easily attached to and removed from the machine.

With this in mind, it has been proposed, for example as described in UK specification no. 1214721, to provide a holder drivably attached to the machine and having a base member from a surface of which extend a plurality of short, narrow filaments the exposed ends of which are enlarged. A non-woven fibrous pad can be pushed onto the filaments, the enlarged heads of the filaments co-operating with the material of the pad to retain the pad in driving relationship with the holder. When it is desired to remove the pad from the holder, the pad is merely pulled away from the holder to disengage the heads of the filaments from the loops of the non-woven fibrous material of the pad.

Such holders do however suffer from a number of serious disadvantages. They commonly comprise a resin base in which are anchored and embedded one end of each of a plurality of individual filaments, the other end of each individual filament being heated and melted to form the required enlarged head thereon. Bearing in mind there will typically be several thousand filaments in even a relatively small pad, it will be appreciated that the manufacturing process, as well as the construction of the holder, is unduly complex.

The filaments comprise a mixture of relatively rigid nylon filaments interspersed amongst a majority of less rigid polypropylene filaments. The latter filaments are prone to undesirable bending when subjected to excessive pressure, the presence of the stronger nylon filaments serving to protect the softer polypropylene filaments against undue distortion. Thus it will be appreciated that a given holder comprises a plurality of components of different materials, adding to the complexity of the device.

The material of the filaments is such that, on repeated attachment and removal of the pad to and from the holder, the filaments are distorted and damaged and tend to break away from the resin base in which they are embedded. Thus the efficiency of the holder tends to deteriorate with use, while these current holders are also found to be less effective on used or compacted pads.

The required enlarged configuration of the free ends of the filaments is, as mentioned above, achieved by heating the filaments to melt the material thereof. However, such treatment does not result in a definitive configuration to the free ends of the filaments, and a suitably hooked or clawed shape to said ends cannot be guaranteed. Furthermore, the different materials of the relatively rigid and less rigid filaments, on the application of a given degree of heat, are melted to differing extents whereby some of the filaments are less distorted than others and provide less of a holding action on the fibrous pad than others.

SUMMARY OF THE INVENTION

It is an object of the invention to provide a holder for a fibrous pad which overcomes the above mentioned disadvantages, and in particular which is of a relatively simple construction and maintains a pad firmly attached thereto, but which enables regular replacement of the pad without damage to the holder.

According to the present invention there is provided a holder for retaining thereon a fibrous product, the holder comprising a base member of a resilient elastomeric material having a surface thereto, and, integrally moulded with said base member to project from said surface, a plurality of hook members, each hook member including a stem portion having a free end remote from the base member and at least one barb portion extending laterally from the free end of the stem portion, the lengths of the stem portions of some hook members being greater than the lengths of the stem portions of other hook members.

Such a holder has numerous advantages over all currently known arrangements. In particular, and being integrally moulded from a resilient elastomeric material, preferably a polyester elastomer, the construction of the holder is relatively simple and the configurations of the hook members are clearly and well defined to provide moulded barb portions for co-operation with the loops of the pads to be attached thereto.

The individual hook members, being of a resilient elastomeric material, are designed to bend or flex and to return to their original positions as soon as pressure thereon is released. Thus, on attachment of a pad, and should a hook member engage a relatively rigid portion of the pad, the hook member bends and accesses the nearest hollow region of the pad.

Similarly, on removal of the pad from the holder and should a hook member be retained in a loop of the pad, the resiliency of the hook member enables it to bend and/or stretch whereby it is released from the loop, and thereafter returns to its original shape and orientation.

In a preferred embodiment of the invention, some at least of the longer stem portions of the hook members include at least one further barb portion extending laterally from the associated stem portion at an intermediate position along the length of the longer stem portion.

The lengths of the stem portions may fall within the range 0.04 inches to 0.32 inches (1 mm to 8 mm), a preferred holder including some stem portions 0.10 inches (2.5 mm) long, the remaining stem portions being 0.16 inches (4 mm) long.

The holder may however include more than two different lengths of stem portions, for example up to four different lengths of stem portion.

DESCRIPTION OF THE PREFERRED EMBODIMENT

Figure 1:
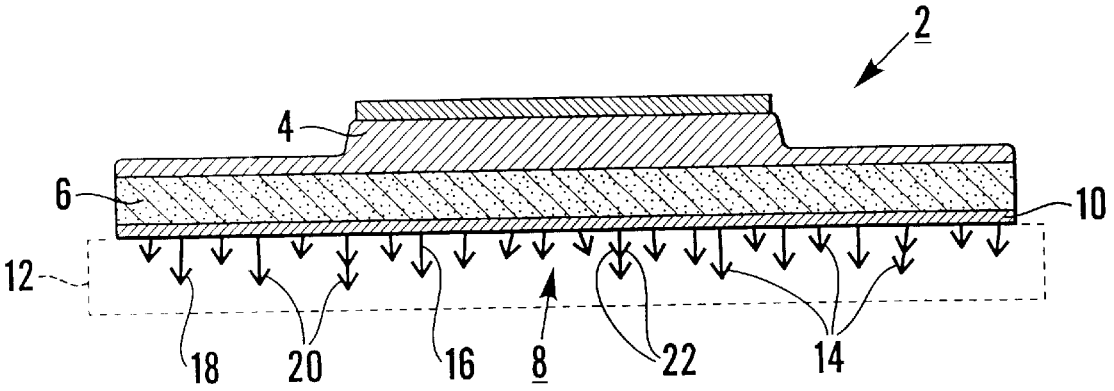
FIG. 1 is a vertical section through a pad holder according to the invention.
Figure 2:
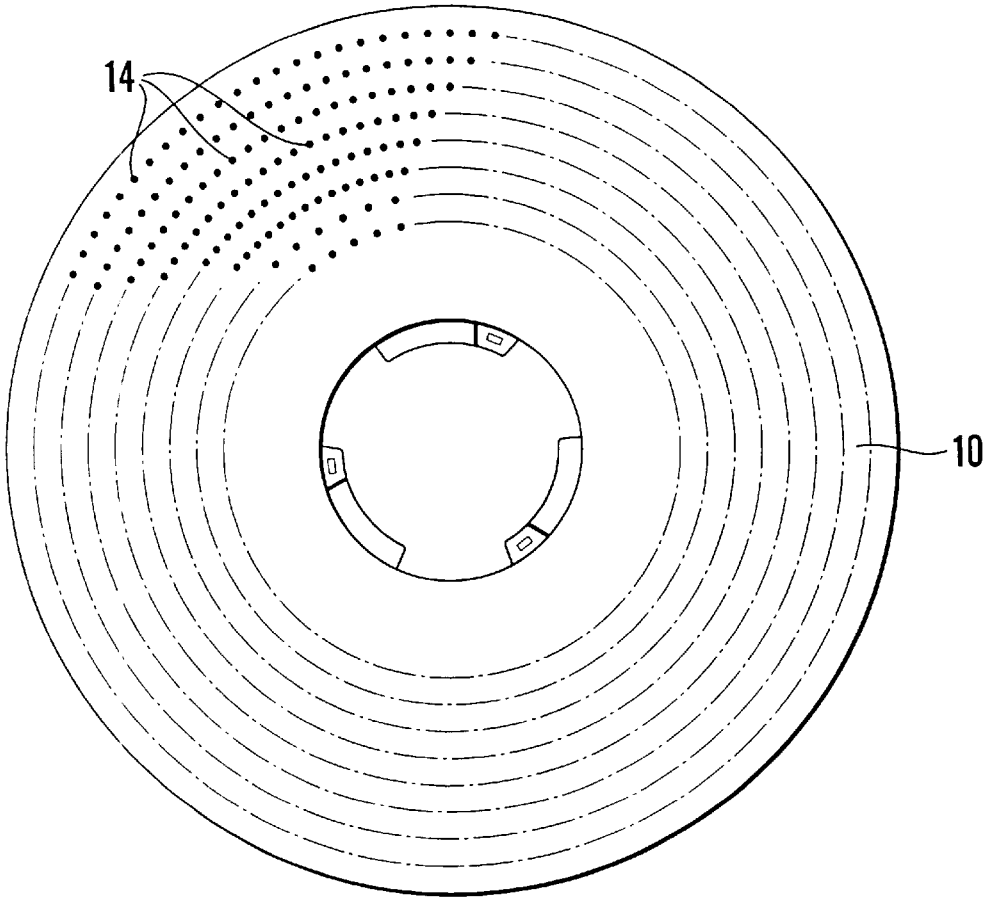
FIG. 2 is an underneath plan view of a pad holder according to the invention showing the locations of some only of the hook members thereon.

Referring to the drawings, a pad holder is indicated generally at 2 and comprises a circular adaptor member 4 of plastic or wood which is attached to the drive system of a rotary or oscillating cleaning machine.

A layer of foam 6 is adhered to the underside of the adaptor member 4 for absorbing vibrations, and a holder member indicated generally at 8 is bonded to the underside of the foam layer 6—the foam layer 6 may be dispensed with if so desired, with the holder member 8 being mounted directly on the adaptor member 4.

The holder member 8 is moulded from a polyester elastomer and includes a circular base member 10 the diameter of which is just less than that of the non-woven fibrous pad to be attached thereto and shown in outline at 12.

Integrally moulded with the base member 10 are a plurality of hook members 14 which extend substantially perpendicularly from the lower surface of the base member 10. The hook members 14 each include a central stem portion 16 and a head portion 18 at the free end of the stem portion 16, the head portion 18 effectively comprising a pair of opposed barb portions 20 projecting laterally from, one to each side of, the stem portion 16.

Figure 3:
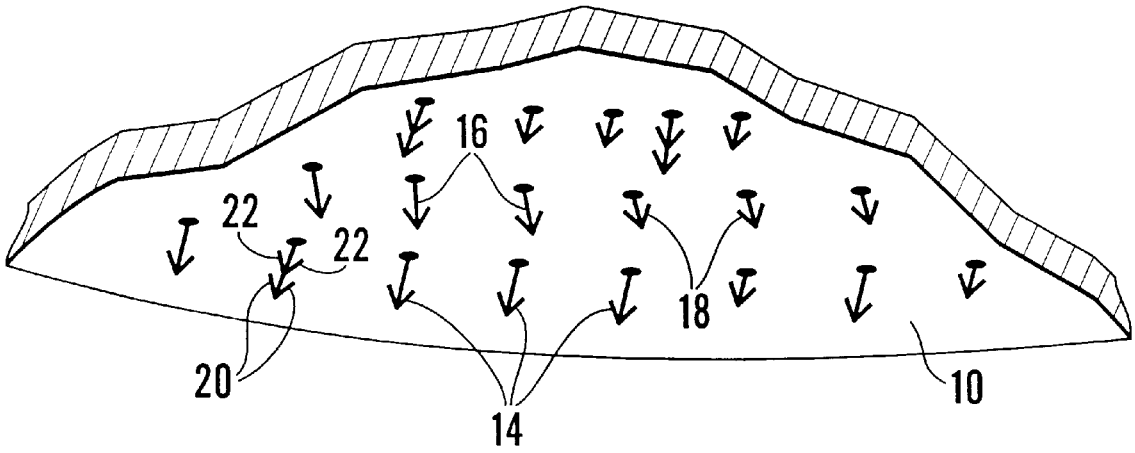
FIG. 3 is an enlarged view of part of a pad holder according to the invention.

As is apparent from FIGS. 1 and 3, the lengths of the stem portions 16 of the hook members 14 differ, and this is an important feature of the invention. More particularly, and as the pad 12 is pushed onto the holder member 8, the head portions 18 embed by differing amounts into the pad to co-operate with loops of pad material in different regions of the pad, thereby creating a positive attachment between the pad 12 and the holder 8. Furthermore, the provision of stem portions 16 of different lengths enables a wider range of pad thicknesses to be attached than would otherwise be the case.

Figure 4:
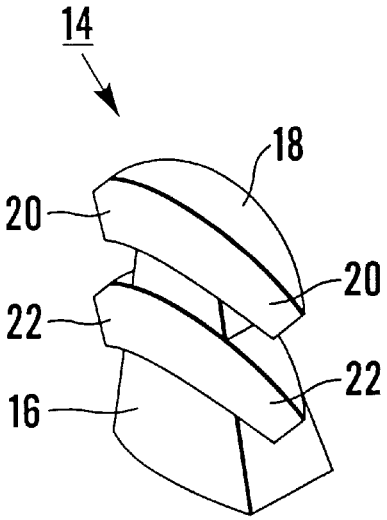
FIG. 4 shows a preferred hook member of a holder according to the invention.

In order to improve the attachment factor even further, some of the longer stem portions 16 are provided with additional barb portions 22 projecting laterally therefrom at intermediate regions along the lengths of the stem portions 16. These barb portions 22 are clearly shown in FIG. 4, and more schematically in FIGS. 1 and 3.

The precise configuration and lay-out of the hook members 14 on the base member 10 can be chosen to suit particular requirements, as can the relative dispositions of the hook members 14 with the shorter and longer stem portions 16, and of the hook members 14 having the longer stem portions 16 with and without the further barb portions 22.

The barb portions 20 and 22 are designed to hook over the loops of the pad material to secure the pad 12 in its operative position on the holder member 8. However, the barb portions 20,22 are also such that, on removing the pad 12 from the holder member 8, they release the pad material without damaging either the pad 12 or the hook members 14. This is achieved primarily as a result of the resilient, elastic nature of the relatively soft material of the hook members 14 as a whole which can bend, flex, stretch and otherwise give to allow release from the loops of the pad 12, the hook members 14 thereafter returning to their normal conditions.

The preferred lengths of the stem portions 16 of the shorter and longer hook members 14 are 0.10 inches (2.5 mm) and 0.16 inches (4.0 mm) respectively, although the full range of lengths may be between 0.04 inches and 0.32 inches (1.0 mm and 8.0 mm) depending upon the thickness of the pad 12 and the material thereof.

There may of course be more than two different lengths of stem portions 16 on a given holder member 8, while all, instead of some of, the longer stem portions of a given length may incorporate additional barb portions 22.

The use of a soft polyester blended to act as an elastomer for the material of the holder member 8 provides a number of advantages additional to those already mentioned.

The base member 10 can flex with the contours of the floor, while the holder member 8 as a whole will not damage a floor if inadvertently used without a pad.

The polyester elastomer is strong and durable yet soft to the touch, is chemical and water resistant, is fully recyclable, and is not affected by heat build-up in the pad. It is anticipated that such a holder member which is primarily for use with driven abrasive pads of up to 24 inches (600 mm) in diameter of nylon, polyesters, natural fibres, steel wool and other non-woven fibrous material, will last for several years under normal operating conditions.

The holder member 8 may however be used in conjunction with non-rotatable, hand held tools, and may serve to attach thereto non-abrasive products such as mops, fibrous cloths and the like.

Although it is preferred that the hook members 14 extend substantially perpendicularly from the surface of the base member 10, they may extend at any angle between 0° and 90° because of their ability to flex and return to their normal condition.

The moulded nature of the holder member 8, and therefore its controlled and balanced thickness, ensures that, in use, the holder 2 is balanced and vibration free under all normal operating conditions.

Thus there is provided a holder primarily for a non-woven abrasive fibrous pad which is of relatively simple but accurately controlled construction and which enables a pad to be securely retained thereon and readily removed therefrom without any damage to the pad or the holder.

What I claim and desire to secure by Letters Patent is:

1. A holder for retaining thereon a fibrous product, the holder comprising a base member of a resilient elastomeric material having a surface thereto, and a plurality of hook members of resilient elastomeric material integrally molded with said base member to project from said surface, whereby said hook members can bend, flex and stretch to allow release from the fibrous product and thereafter return to a neutral position, each hook member including a stem portion having a free end remote from the base member and at least one barb portion extending transversely from the free end of the stem portion at least some of said hook members having a second barbed portion extending transversely from the associated stem portion, the lengths of the stem portions of some hook members being greater than the lengths of the stem portions of other hook members.

2. A holder as claimed in claim 1 wherein said second barbed portion on at least some of the longer stem portions of the hook members extends transversely from the associated stem portion at an intermediate position along the length of the longer stem portion.

3. A holder as claimed in claim 1 in which the lengths of the stem portions fall within the range 0.04 inches to 0.32 inches (1 mm to 8 mm).

4. A holder as claimed in claim 3 in which the lengths of the stem portions are 0.10 inches and 0.16 inches (2.5 mm and 4 mm).

5. A holder as claimed in claim 1 wherein each of said hook members includes said second barbed portion.

* * * * *